United States Patent [19]

Shimek et al.

[11] Patent Number: 4,793,322

[45] Date of Patent: Dec. 27, 1988

[54] DIRECT-VENTED GAS FIREPLACE

[76] Inventors: Ronald J. Shimek, 8996 W. 154 St., Prior Lake, Minn. 55372; Daniel C. Shimek, 5260 W. 132d St., Apple Valley, Minn. 55124

[21] Appl. No.: 927,744

[22] Filed: Nov. 6, 1986

[51] Int. Cl.[4] ..... F24C 1/14

[52] U.S. Cl. ..... 126/80; 126/83; 126/85 B; 126/89; 126/193; 126/290; 126/503; 126/512; 126/518; 126/521; 126/527; 126/531; 126/533

[58] Field of Search ..... 126/27, 80, 83, 85 R, 126/85 B, 89, 90 R, 86, 92 R, 92 AC, 121, 123, 127, 193, 288, 289, 290, 307 R, 316; 98/46, 48

[56] References Cited

U.S. PATENT DOCUMENTS

| | | | |
|---|---|---|---|
| 2,998,764 | 9/1961 | Bedell et al. | 126/85 B X |
| 3,168,088 | 2/1965 | Martin et al. | 126/77 |
| 3,614,948 | 10/1971 | Jackson et al. | 126/85 B |
| 3,741,194 | 6/1973 | Herron | 126/85 B |
| 4,141,336 | 2/1979 | Fitch | 126/121 |
| 4,184,473 | 1/1980 | McIntire et al. | 126/77 |
| 4,424,792 | 1/1984 | Shimek et al. | 126/312 |
| 4,494,525 | 1/1985 | Albertsen | 126/289 |
| 4,519,376 | 5/1985 | Schoeff et al. | 126/121 |
| 4,545,360 | 10/1985 | Smith et al. | 126/77 Y |

*Primary Examiner*—Margaret A. Focarino
*Attorney, Agent, or Firm*—John B. Sowell

[57] ABSTRACT

A zero clearance fireplace of the type to be installed inside of a building against or near an outside wall is provided. The box shaped fireplace is provided with four substantially vertical walls, a top wall and a bottom wall. The bottom wall comprises an inner plenum and an outer plenum below the combustion chamber. The rear wall comprises an outer plenum connected to the bottom plenum of the bottom wall, a middle plenum connected to a source of fresh air and connected to the inner plenum of the bottom wall and an inner plenum which is connected to a horizontal exhaust pipe which is inserted through the outside wall and is connected to the combustion chamber through a baffle arrangement.

15 Claims, 3 Drawing Sheets

DIRECT-VENTED GAS FIREPLACE

BACKGROUND OF THE INVENTION

1. Field of the Invention

The present invention relates to a zero clearance fireplace of the type usually installed through an exterior wall of a room to be heated. More particularly, the present invention relates to a prefabricated and factory built directvented zero clearance gas fireplace and to a horizontal exhaust pipe system which brings in outside combustion air and reduces the exhaust gas temperatures to below underwriters standards.

2. Description of the Prior Art

The purpose of the present invention is to provide a fireplace which eliminates a conventional masonry or prefabricated metal chimney. Masonry chimneys are usually made with two walls, one of which is an inner tile wall that rises above the highest point of a roof of a house. Masonry chimneys made with an original house are expensive. However, such chimneys are even more expensive when added to a house that is already built. To overcome the high cost of masonry chimneys, prefabricated metal chimneys have been designed such as those set forth in our U.S. Pat. No. 4,424,792. The heater described in this patent is adapted to burn any type of fuel in a free standing heating unit and to cool the hot exhaust gases by mixing outside fresh cool air with the hot exhaust gases before discharging them to the atmosphere. Such free standing heating units require an induced draft system which is mounted on the exterior wall, thus limiting this application to residential or commercial buildings which would permit the installation of a large motor contained box on the exterior wall. Numerous apartment buildings and multi-story condominium buildings have building requirements and zoning requirements which prohibit the installation of an induced draft fan system on the outside wall.

Heretofore, fireplaces have been provided in multistory buildings by providing a required Class A chimney. Such chimneys require either a triple wall, double wall or insulated wall type installation. These Class A chimneys cannot be economically installed in a newly built building or retrofitted into an existing multi-story building. The lowest cost such retrofitted chimney would be a prefabricated chimney. If such a prefabricated metal chimney is installed through the ceiling of a room and eventually through the roof of a highrise building, there arise numerous problems requiring cutting through numerous ceilings and the roof and then providing special flanges and/or adaptors and flashing in order to seal against leaks. When such prefabricated metal chimneys are built into an interior room of a multi-story house, the clearance between the flammable ceiling and the roof structure becomes critical because the metal chimneys are often operated at a temperature which often rises above the kindling temperature of the adjacent structures.

Another problem associated with installing fireplaces in multi-story buildings is that when using gas as a fuel, the air for combustion of the gas must be supplied from some source other than the room being heated, otherwise, the oxygen levels in the room are depleted to an unsafe level by underwriters' standards.

It would be extremely desirable to provide a prefabricated structural fireplace which eliminates the aforementioned problems associated with conventional chimneys and gas fired burning fireplaces. It would be extremely desirable that the fireplace be economical to build and economical to install while providing extremely high burning efficiency and while meeting the safety and environmental standards associated with installation of a fireplace in a highrise or multi-story building.

SUMMARY OF THE INVENTION

The primary object of the present invention is to provide a fireplace system for eliminating a conventional chimney for gas fireplaces.

Another primary object of the present invention is to provide a zero clearance fireplace having a horizontal exhaust pipe for installing directly through an exterior wall and providing suitably cooled exhaust gases without the necessity for installing induced draft fan systems on the outside wall.

It is another primary object of the present invention to provide an economical exhaust system for a free-standing gas fireplace having a horizontal vented exhaust pipe that installs directly through a hole in an exterior wall.

It is another primary object of the present invention to provide a plurality of novel plenums at the rear wall of a zero clearance or free-standing gas fired fireplace which cools the exhaust gases below the underwriters' specification standards, thus, permitting installation in office buildings and high rise and multi-story condimunium type buildings.

It is a general object of the present invention to provide a novel arrangement of plenums and baffles and exhaust pipes for a zero clearance fireplace which cools the exhaust gases immediately before leaving the fireplace so as to minimize fire hazards.

It is another general object of the present invention to provide a novel vent cap for an exhaust pipe system which further cools the exhaust gases before entering into the atmosphere.

In accordance with these and other objects of the present invention, there is provided a zero clearance fireplace of the type adapted to be installed adjacent an outside wall of an interior space to be heated. The fireplace is preferably box shaped and provided with four substantially vertical walls, at least one of which is adapted to have a glass access door mounted therein. One of the vertical walls comprises an inner plenum connected to a horizontal exhaust pipe and an outer plenum which is connected to a plenum below the combustion chamber. A third or middle plenum intermediate the outer and inner plenums of the multi-plenum vertical wall is connected to a source of outside air which is directed through a novel plenum arrangement to the combustion chamber and to diffusers which maintain the glass access doors both clean and cool before the outside air is used for a product of combustion.

DESCRIPTION OF THE PREFERRED EMBODIMENT

Before referring to the specific figures and their description, for purposes of this application, a zero clearance fireplace shall mean a prefabricated fireplace having outer metal walls which are sufficiently cooled by air plenums or insulation so that they may be installed close to a wall or adjacent to combustible materials. Thus, the bottom, back and two side walls of a zero clearance fireplace are cool enough in normal operation to be installed against wood. This does not mean that a structure designed as a zero clearance fireplace may not be used as a free standing fireplace and installed in the same location several feet or even more from a wall of combustible material. It is intended that the present invention fireplace may be installed in any location that the aforementioned residential heater described in our U.S. Pat. No. 4,424,792 may be installed.

Figure 1:
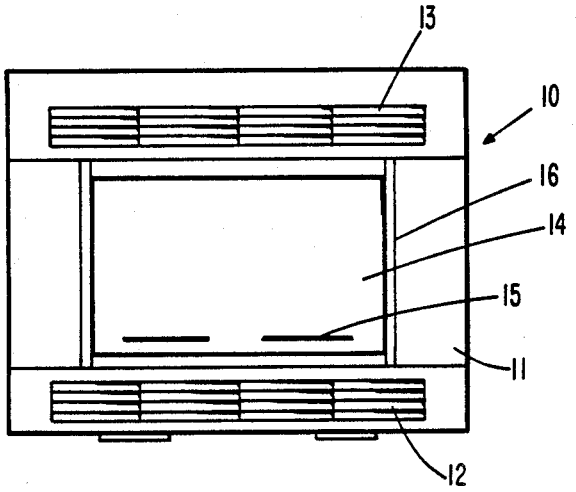
FIG. 1 is a front view in elevation of the preferred embodiment zero clearance gas fired vented fireplace.

Refer now to FIG. 1 showing in front view a zero clearance fireplace of the type in which the present invention can be originally installed or retrofitted. The fireplace 10 comprises a front wall 11, having an air inlet grill 12 and an air outlet grill 13 which cover the intake and exhaust of a series of plenums and chambers for circulating room air around the outside of the combustion chamber and exhausting it through the outlet grill 13 back into the room to be heated. A glassed access door 14 having handles 15 is fitted into the opening 16 of the wall 11. In the preferred embodiment gas fireplace of the present invention, the glass access door 14 is either openable or removable but is preferably airtight or semi-airtight. The reason for providing an airtight door is to prevent any air loss from the room because the amount of combustion air taken from the room reduces the amount of oxygen in the room if the room is relatively tightly sealed or alternatively takes in outside air cooling the room to be heated.

Figure 2:
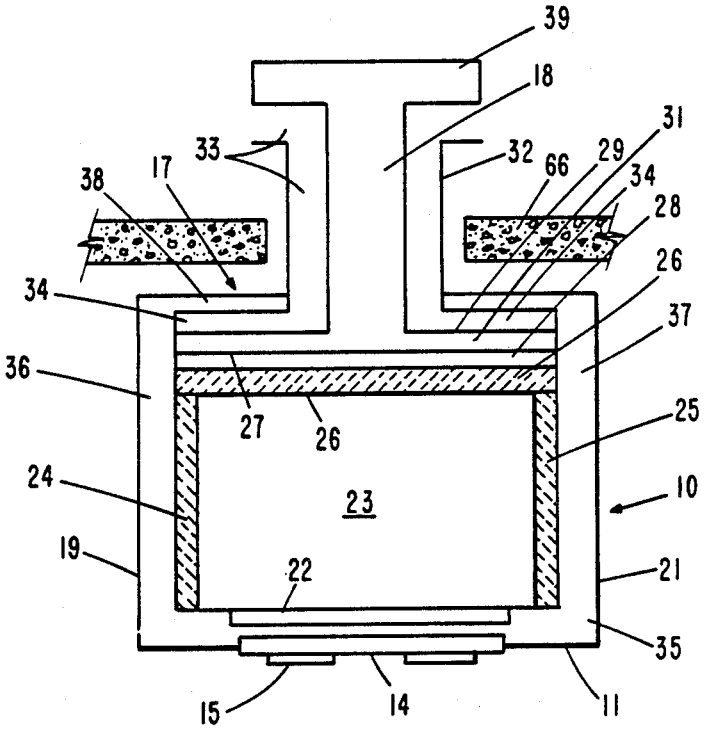
FIG. 2 is a simplified top view in section thorugh the preferred embodiment fireplace shown in FIG. 1, adapted to show the vertical sidewalls and the rear wall which is connected to a preferred embodiment horizontal exhaust pipe and aspirating cap.

Refer now to FIG. 2 showing a plan view in section which is taken through the rear wall 17 at the exhaust pipe 18 and through the front wall 11 and side walls 19 and 21 through the lower part of the glass access door 14. The glass access door is mounted at the front of the front wall 11 so that an air wash duct 22 may be provided in the front wall 11. The air wash duct 22 is preferably connected to a source of outside fresh air, as will be explained in detail later, and sweeps vertically upward on the inside of the glass door 14 so as to cool the glass in the door as well as to provide primary combustion air for the fire in the combustion chamber 23. Combustion chamber 23 is surrounded on three sides by refractory panels 24, 25 and 26. Refractory panel 26 is spaced apart from the rear panel 27 of the combustion chamber 23 so as to provide a conduit or passageway 28 for the exhaust gases leaving the combustion chamber 23 as will be explained in greater detail hereinafter. The rear panel 27 of the combustion chamber is also spaced apart from a transverse panel 29 and forms an intermediate plenum 31 between panel 29 and panel 27 in which the exhaust gases must pass after leaving passageway 28 and before entering the exhaust pipe 18. A cool fresh air pipe 32 is coaxially mounted around the exhaust pipe 18 and provides a passageway 33 for cool outside air to enter the middle or intermediate plenum 34 before being directed downward and into a plenum below the combustion chamber which supplies the primary and secondary air for combustion of the gas in the gas burner of the combustion chamber 23. The front wall 11 is provided with a duct or passageway 35 which connects to the intermediate plenum 34 as will be explained in detail hereinafter. Vertical sidewalls 19 and 21 are provided with outer vertical plenums 36 and 37. The air entering through air inlet grill 12 is preferably directed into outer plenums 36 and 37 as well as into outer rear plenum 38 which forms a part of rear wall 17.

It will be understood that exhaust gases leaving combustion chamber 23 are directed vertically upward so that they enter into the exhaust passageway 28 and are then directed downward until they pass through the rear panel 27 of the combustion chamber and are then directed again upwardly into the exhaust pipe 18 where they are defused and cooled when leaving the aspirating vent cap 39 which will be explained in greater detail hereinafter.

Figure 3:
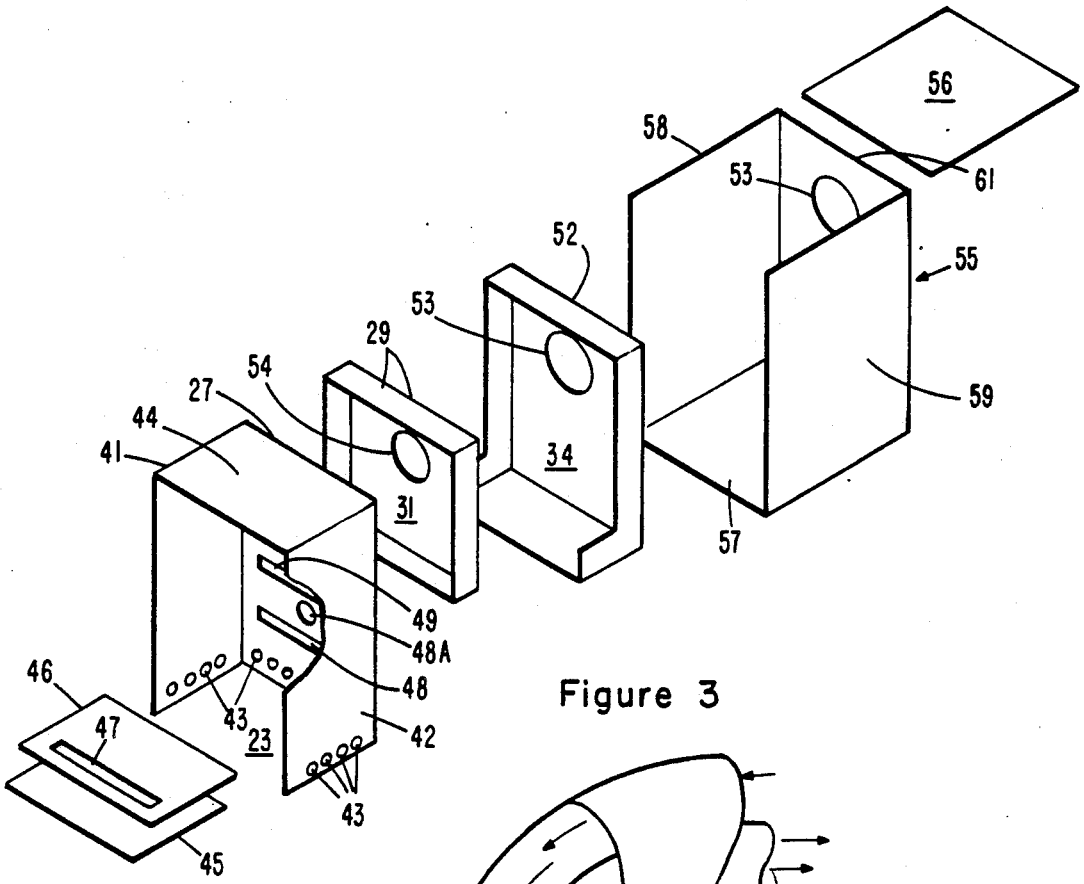
FIG. 3 is an exploded view of the preferred embodiment sheetmetal plates shaped to form a plurality of plenums which surround the combustion chamber and provide cooling of the combustion chamber and the sidewalls as well as the exhaust gases being exhausted out the exhaust pipe.

Refer now to FIG. 3 showing an exploded view of the preferred embodiment sheet metal plates which are shaped to form the plenums and the combustion chamber. The rear wall 27 of the combustion chamber 23 is provided with sidewalls 41 and 42 which extend the length of the rear wall. These vertical wall plates are provided at their bottom edge with apertures 43 through which the room air from the intake grill 12 flows in order to enter the outer plenums 36, 37 and 38. A top plate 44 is attached to the sidewalls of the combustion chamber and forms the inner plate of the top plenum as will be explained hereinafter. Bottom plates 45 and 46 are shown spaced apart from each other in the manner in which they are connected to the sidewalls of the combustion chamber above the apertures 43. The bottom plates 45 and 46 form the lower inner plenum as will be explained in greater detail hereinafter. A fresh air slot 47 is provided in top plate 46 and a fresh air slot 48 is provided in the rear vertical wall 27 of the combustion chamber 23. The combustion gases from the combustion chamber 23 after passing down the passageway 28 behind the refractory panel 26 are directed through the exhaust slot 49 into the inner plenum 31 formed by plate 29 having lateral flanges to form a hollow box which attaches to the back of rear panel 27 of the combustion chamber 23 above the fresh air slot 48.

The plate 27, which forms the rear wall of combustion chamber 23, is provided with an exhaust slot 49. The location of slot 49 is determined by measuring the temperature of the exhaust gases 63 in the horizontal exhaust pipe 18 before entering the aspirating cap 39. Thus, by lowering slot 49, the path of the exhaust gases is lengthened and made cooler.

Underwriter standards for gases being exhausted horizontally through a wall specificy 480° F. plus room temperature in the exhaust pipe. The present invention novel baffle arrangement is capable of reducing 1000° F. exhaust gases in the top of combustion chamber 23 to approximately 400° F. in the exhaust pipe 18 at the wall 66, thus, creating a more efficient heater while enhancing the factor of safety. Also, the 400° F. exhaust gases are cooled further by the cool fresh air pipe 32 before being further cooled by the aspirating cap 39.

The intermediate plenum 34 is formed by the odd shaped open box plate 52 and connects to the back of box 29 and below the fresh air slot 48 thus forming a fresh air plenum or intermediate plenum 34. It will be understood that the fresh air supplied between bottom plates 45 and 46 has passed below box 29 from the plenum 34 which is connected to the cool fresh air pipe 32 at aperture 53. In a similar manner, the exhaust gases from combustion chamber 23 which pass through the exhaust slot 49 into the inner plenum 31 pass through the aperture 54 which is connected to the exhaust pipe 18.

The outer metal shell 55 comprises a top plate 56, a dimpled bottom plate 57, sidewalls 58 and 59 and a rear wall 61 having an identical aperture 53 through which passes the aforementioned fresh air pipe 32 and coaxially therein the exhaust pipe 18. It will be understood that the outer metal shell forms a plurality of outer walls spaced apart from the walls of the combustion chamber 41, 42 and 27, etc. so as to provide outer plenums for cooling the combustion chamber, for heating recirculated room air and for providing the zero clearance feature.

Figure 4:
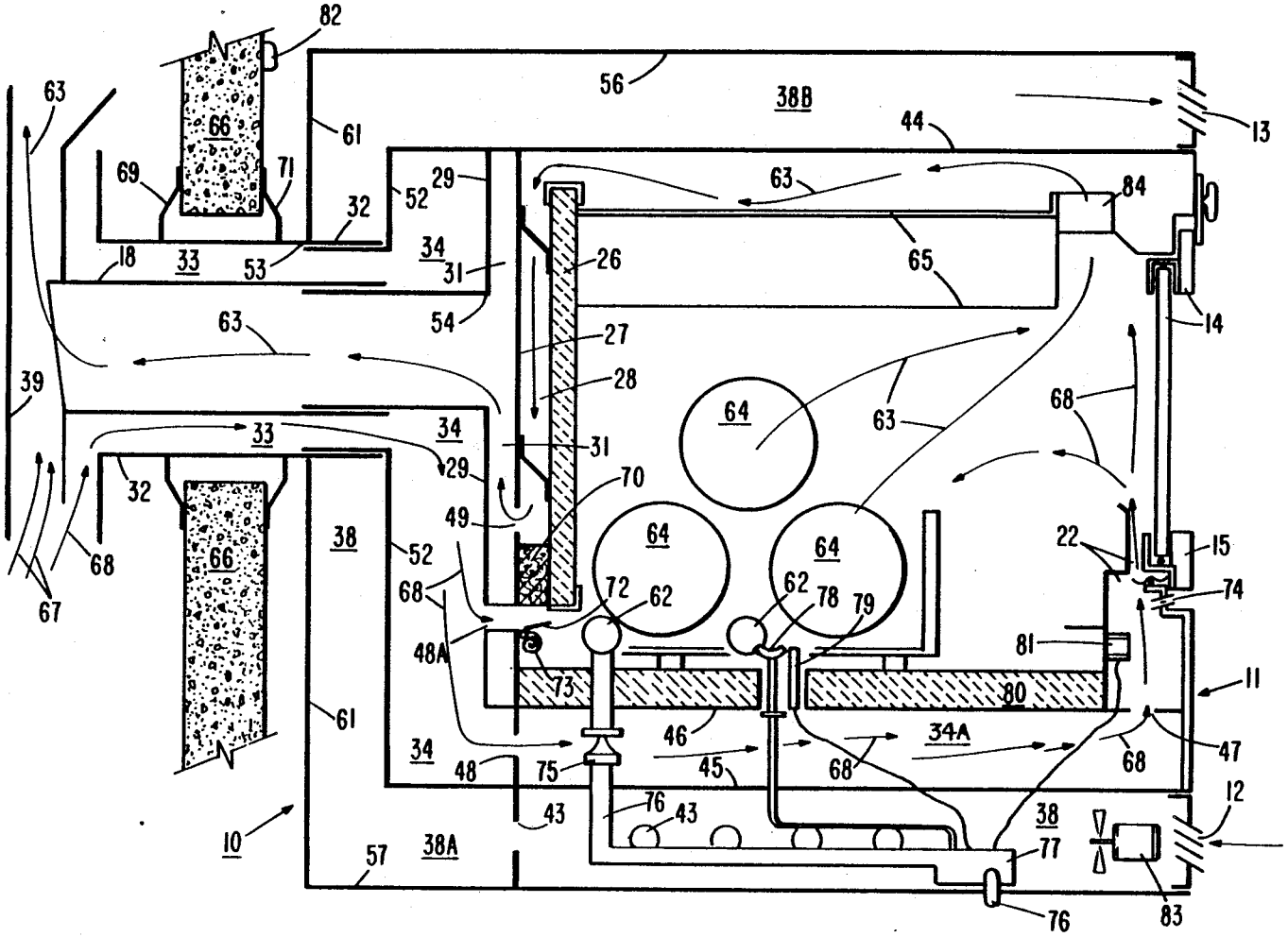
FIG. 4 is a schematic drawing in side elevation and in cross section adapted to illustrate the novel plenum chambers at the rear wall and to show the exhaust pipe end cap.

Refer now to FIG. 4 showing a detailed schematic drawing in side elevation and cross section the novel plenum and passage chambers for heated air, exhaust gases and fresh air. First assume that the gas supplied to gas burner 62 is creating hot exhaust gases shown by lines and arrows 63 which must be exhausted from the combustion chamber 23 having ceramic logs 64 which are heated by the exhaust gases 63. In the preferred embodiment of the present invention, an arched shaped baffle 65 forces the exhaust gases around the sides and the ends of baffle 65 so as to heat top plate 44 while passing over the baffle 65 to enter the passageway 28 between the refractory plate 26 and the rear wall 27 of the combustion chamber. The combustion gases pass downward in passageway 28 until they reach exhaust slot 49 in plate 27 where the exhaust gases 63 pass into the inner plenum 31. The exhaust gases 63 in plenum 31 enter the exhaust pipe 18 and are directed horizontally through the exterior wall 66 of the room in which the fireplace is located and pass into the aspirating exhaust cap 39 where they are directed upward and outward into the atmosphere after being mixed with aspirated fresh outside air shown by the lines and arrows 67. Fresh air 68 also enters into the passageway 33 formed by the cool fresh air pipe 32 and the exhaust pipe 18. Cool fresh air 68 passes through outside wall 66 where decorative collars and spacers 69 and 71 are shown connected to wall 66 for maintaining pipe 32 spaced apart therefrom. The fresh air passageway 33 conducts the fresh outside air 68 through the outside wall 66 and past the outer plenum 38 into the middle or intermediate plenum 34. The outside fresh air is directed downward in middle plenum 34 into the inner bottom plenum 34A where it passes through fresh air slot 47 and is conducted through air wash duct 22 and the narrow passageway at the top of the duct 22 along the inside of the glass of glass access door 14 to keep the glass cool and clean. The fresh air 68 swirls and passes into the combustion chamber area 23 and a very small percentage is combined with the hot exhaust gases 63 to form secondary combustion before entering the passageway 28.

Because of the problem of starting a gas burner under cold conditions, a supply of secondary air is supplied directly to the burner area. Until the gas logs 64 and the inner surfaces of the combustion chamber 23 reach a reasonably elevated temperature, the hot exhaust gases are not present and are insufficient to produce or induce a draft or draw on the primary fresh air at air wash duct 22. To overcome this initial condition, a small amount of fresh air is provided near the burner 62 at slot 48A which connects to fresh air plenum or middle plenum 34. The cross section of the fresh air slot 48A is made smaller than the primary air wash duct 22 by a ratio of one-tenth to one-third so that no additional air controls are normally necessary. When it is desirable to increase the efficiency of combustion and shut off the excess fresh air from the secondary source fresh air slot 48A, a pivoted damper 72 may be installed to close off the slot 48A when the bi-metallic spring 73 heats up. It will be noted that the secondary fresh air supply at slot 48A or 48 may be supplied by an individual pipe connected to a source of outside fresh air or room air and need not be supplied from the middle fresh air plenum 34. While it is not a preferred embodiment for reasons explained hereinbefore, a manually controlled damper or an open aperture 74 may be provided below the glass door 14 so as to introduce either primary air or secondary air. Whenever combustion air is taken from the room in which the fireplace is located, it either depletes to some extent the oxygen in the room or creates a partial vacuum which takes in cold air or air from other parts of the building into the room to be heated, thus defeating the primary purpose of the heating unit.

An adjustable venturi 75 is placed in series in the gas supply line 76 to the burner 62. The adjustable venturi permits the adjustment of the fuel air ratio being supplied to the burner 62 so as to permit adjustment of the color of the burning flame in addition to correcting and adjusting the carbon monoxide (CO) level in the exhaust gases of the combustion chamber.

Control 77 is preferably a B67 MIDGITROL automatic control made by ITT for regulating the gas pressure to the burner 62 as well as monitoring and controlling the pilot light 78 and the thermostatic sensing control 79. A thermal high limit switch 81 which provides an on/off condition in response to an overly high temperature in the combustion chamber area 21 is also connected to the control 77. Thus, should the glass in the access door 14 be broken or the exhaust pipe 18 be blocked, the temperature would rise in the combustion area 23 and cause the switch 81 to open and close off the gas supply in gas pipe 76. Such controls are well known in the gas heating business and are usually required by underwriters. At this point, it should be noted that a remotely located low voltage wall thermostat such as that shown at 82 on wall 66 for convenience may be connected in series with the thermal switch 81 and control the on/off condition of the gas supply to the burner 62 depending on the demand from the thermostat 82 for heat in the room. The pilot light 78 is normally on and the system is shut down by the sensor 79 when the pilot light goes out.

The outer plenum or heat chamber, which in FIG. 4 is numbered 38, 38A, 38B, is shown as a "U" shaped heat exchanger surrounding the combustion chamber 23. An optional motor-driven fan 83 may be installed in plenum 38A opposite the inlet grill 12 so as to enhance the circulation of room air through the heat exchanger. Heated air is exhausted through the outlet grill 13. An optional catalytic converter may be installed in the support 84 through which the exhaust gases 63 must pass. The catalytic combustor is used when it is necessary to reduce the carbon monoxide (CO) content of the exhaust gases being exhausted to the atmosphere.

Insulation such as glass wool 70 may be inserted between the lower end of plate 27 and refactory plate 26. The floor 80 of furnace 23 may be provided by a refractory slab or preferably a rock wool or particulate which also form a seal around elements 76, 78 and 79.

Figure 5:
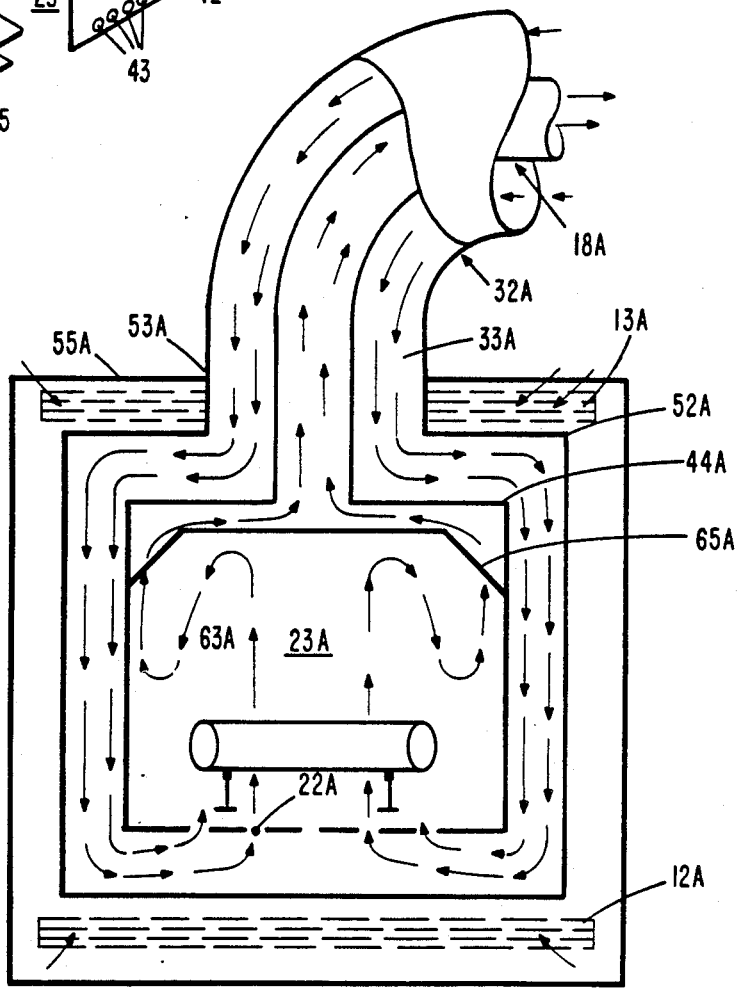
FIG. 5 is a simplified schematic drawing of a modified embodiment structure in front elevation and in cross section showing one way of adapting the novel rear wall structure of the preferred embodiment multiple plenum system so that it may be used as a top wall.

Refer now to FIG. 5 showing a modified embodiment of the zero clearance fireplace in which the novel rear wall of the preferred embodiment has been reconstructed for installation as the top wall on a zero clearance fireplace. The top wall has a top exhaust pipe which is directed horizontally to pass through an exterior wall. Exhaust pipe 18A is connected to top plate 44A of the combustion chamber 23A. The cool fresh air pipe 32A is connected to plenum box 52A. Both pipes 32A and 18A pass through an aperture 53A in the outer shell 55A. The primary fresh air for combustion is conducted through passageway 33A to the primary air wash duct 22A. The hot exhaust gases 63A are directed by the baffle 65A along the top of the combustion chamber before entering the exhaust pipe 18A. The air from the room to be heated enters the inlet grill 12A and is directed into the heat exchange plenums on the bottom, top and sides of the fireplace formed between the combustion chamber 23A and the outer shell 55. It will be noted that the modified embodiment of FIG. 5 does not cool the exhaust gases as well as the preferred embodiment, having three plenums or passageways on the rear wall.

Having explained the preferred embodiment zero clearance fireplace for burning gas fuel, it will now be understood that a zero clearance or a free standing gas fired fireplace may be provided with a horizontal direct vented exhaust pipe which may be installed in new buildings much less costly than would be possible using a conventional Class A type chimney. Moreover, the present preferred embodiment zero clearance fireplace offers greater efficiency at much lower cost of installation than original equipment in a newly designed building. The novel fireplace may also be installed in older buildings which were not designed for installation of fireplaces.

The present zero clearance fireplace may be installed through the wall of a multi-story building at high elevations by the simple means of installing the cap and dress plate from the outside. The exterior vent cap may be designed so that it can be lowered to its position from a roof and installed by pulling it into the wall opening.

What we claim is:

1. A zero clearance fireplace of the type adapted to be installed against an outside wall of an interior space to be heated, comprising:

a box shaped fireplace having six walls comprising four substantially vertical walls, a top wall, and a bottom wall, at least one of said four vertical walls having a glass access door and one of said remaining walls having a horizontal exhaust pipe connected thereto for insertion through said outside wall of the space to be heated, a combustion chamber in said box shaped fireplace located within said six walls, said bottom wall comprising an inner, and an outer bottom plenum below said combustion chamber, the wall having said horizontal exhaust pipe connected thereto comprising an inner plenum, a middle plenum and an outer plenum, said outer plenums being connected to form an air passage for interior space air being circulated around the outside of said fireplace combustion chamber and exhausted as heated air into said interior space to be heated, said bottom inner plenum and said middle plenum being connected together and to a source of outside fresh air and connected to said combustion chamber to provide primary combustion air, and said horizontal exhaust pipe being connected to said inner plenum of said wall having said horizontal exhaust pipe connected thereto, said inner plenum being connected to said combustion chamber for receiving and exhausting exhaust gases from said combustion chamber.

2. A zero clearance fireplace as set forth in claim 1 wherein said vertical walls not having an access door therein or a horizontal exhaust pipe connected thereto comprise outer plenums in said walls, connected to said outer plenum of said bottom wall.

3. A zero clearance fireplace as set forth in claim 1 wherein the wall having said horizontal exhaust pipe connected thereto is the rear vertical wall and said inner plenum of said rear vertical wall is spaced apart from an inner refractory lining of said combustion chamber and forms a vertical passageway therebetween for directing exhaust gases vertically downward and subsequently through an exhaust gas aperture in said inner plenum for receiving said exhaust gas and for directing said exhaust gases vertically upward in said inner plenum and into said exhaust pipe.

4. A zero clearance fireplace as set forth in claim 3 wherein said inner plenum of said rear vertical wall is formed by a vertical depending plate connected to said top wall and to the two adjacent side walls.

5. A zero clearance fireplace as set forth in claim 1 which further includes a second source of outside fresh air connected to said middle plenum and to said combustion chamber.

6. A zero clearance fireplace as set forth in claim 1 which further includes an air wash duct adjacent said glass access door connected to said inner plenum of said bottom wall for directing said outside fresh air past the inner surface of said glass access door before being used as air for combustion in said combustion chamber.

7. A zero clearance fireplace as set forth in claim 1 which further includes a gas burner, a gas pilot light and a thermal sensor in said combustion chamber.

8. A zero clearance fireplace as set forth in claim 1 which further includes a gas burner connected to a gas control valve, a temperature limit switch connected to said gas control valve for shutting off gas to said gas burner when the fire in said combustion chamber becomes hotter than a predetermined limit.

9. A zero clearance fireplace as set forth in claim 1 which further includes a source of secondary combustion air and wherein the ratio of primary combustion air to secondary combustion air is between three-to-one and ten-to-one.

10. A zero clearance fireplace as set forth in claim 9 which further includes a pivoted damper mounted at the source of said secondary combustion air at the inlet to said combustion chamber, and thermostat means for closing said damper when the temperature in said combustion chamber rises to a level which indicates the presence of a hot stabilized fire.

11. A zero clearance fireplace as set forth in claim 1 which further includes an aspirating exhaust pipe cap, said exhaust pipe cap comprising an outer cover plate, an intermediate cover plate and an inner cover plate.

12. A zero clearance fireplace as set forth in claim 11 wherein said outer cover plate and said intermediate cover plate forms an aspirating chamber connected to said exhaust pipe.

13. A zero clearance fireplace as set forth in claim 11 wherein said exhaust pipe comprises an outer fresh air pipe and an inner hot exhaust gas pipe, and wherein said inner cover plate and said intermediate cover plate form a fresh air intake chamber connected to said outer fresh air pipe.

14. A zero clearance fireplace of the type adapted to be installed against an outside wall of an interior space to be heated, comprising:

a box shaped fireplace having four substantially vertical walls, at least one of said walls having a glass access door, a rear wall comprising one of said remaining vertical walls having a horizontal exhaust pipe connected thereto for insertion through said outside wall of said space to be heated, a top wall having an outer plenum, a bottom wall having an outer plenum, a combustion chamber in said box shaped fireplace inside said vertical walls, said rear wall further comprising an intermediate plenum outside said combustion chamber connected to said horizontal exhaust pipe, said rear wall further comprising an outer plenum connected to said bottom outer plenum and to said top outer plenum forming a U-shaped heat exchanger for circulating interior space air around the outside of said combustion chamber of said fireplace and for exhausting heated air into said interior space to be heated, said rear wall further comprising a vertical baffle spaced apart from the rear of said combustion chamber for directing combustion gases first in a vertically downward direction and then in a vertically upward direction and into said horizontal exhaust pipe.

15. A zero clearance fireplace as set forth in claim 14 which further includes air wash duct diffuser means adjacent said glass access door.

* * * * *